United States Patent [19]

Vallance

[11] Patent Number: 4,629,136

[45] Date of Patent: Dec. 16, 1986

[54] DEMOUNTABLE TWO-PART REEL

[75] Inventor: Leslie Vallance, Livingston, Scotland

[73] Assignee: Burroughs Corporation, Detroit, Mich.

[21] Appl. No.: 716,769

[22] Filed: Mar. 27, 1985

[30] Foreign Application Priority Data

Apr. 7, 1984 [GB] United Kingdom ..... 8409050

[51] Int. Cl.[4] ..... B65H 75/22

[52] U.S. Cl. ..... 242/71.8; 242/115

[58] Field of Search ..... 242/71.8, 71.9, 115, 242/116, 117, 77.3, 118.4, 118.6, 118.61, 118.62, 118.8

[56] References Cited

U.S. PATENT DOCUMENTS 4,039,156 8/1977 Abraham ..... 242/115

FOREIGN PATENT DOCUMENTS 645076 4/1937 Fed. Rep. of Germany ..... 242/71.8
1144588 2/1963 Fed. Rep. of Germany ..... 242/71.8
1156640 10/1963 Fed. Rep. of Germany ..... 242/71.8

*Primary Examiner*—John M. Jillions
*Attorney, Agent, or Firm*—Mark T. Starr; Kevin R. Peterson

[57] ABSTRACT

A demountable reel for the winding thereon of a paper web comprises two identical sub-assemblies. Each sub-assembly comprises a pair of fingers disposed on opposite sides of the axis of rotation of the reel and held on an end cheek. When the two identical sub-assemblies are brought together with the fingers interleaved, the fingers each define one of four quadrants of the surface of the shaft of the reel. The fingers in each sub-assembly are provided with elastic clips for engaging the end cheek on the other sub-assembly. A bearing protrusion on each finger engages the cheek in the other sub-assembly to support the fingers against crushing by a roll of paper web. The fingers trap the web between them to allow winding of the reel in any direction. In a second preferred embodiment, each sub-assembly comprises a set of three fingers for interleaving with a corresponding set of three fingers from a second modified sub-assembly.

29 Claims, 18 Drawing Figures

34
44
46
48
50
60
76
78
80
320
340
420
600
720
18

DEMOUNTABLE TWO-PART REEL

BACKGROUND OF THE INVENTION AND THE PRIOR ART

1. Field of the Invention

The present invention relates to a reel for the winding thereon of a web to form a roll, the reel thereafter being demountable to release the roll. The present invention particularly relates to such a reel having two mutually-engagable and disengagable parts. Most particularly, the present invention relates to such a reel having a pair of end cheeks and a shaft, the web being wound onto the shaft between the end cheeks.

The present invention is hereinafter described in relation to its use in the winding of a paper web in keeping a printed record of the transactions carried out by an autoteller. It is to be appreciated that this use of the present invention is by way of example only and is not intended to indicate a limitation to its field of application.

2. Prior Art

It is the custom in autotellers, cash registers and point of sale terminals, to maintain a printed record of the receipt given to the customer. A copy is made of each slip given to the customer on a continuous paper web. The copy can either be made in a separate printing operation or can be achieved by the use of two-layer self-copying paper, the top sheet being given to the customer and the continuous carbon copy on the bottom sheet being wound onto the record retaining reel.

It is necessary at intervals to change the reel as it becomes full. A first problem arises in that as the paper web is wound onto the reel the tension in each of the increasing number of layers is additive, causing the paper roll formed by winding the web onto the reel to become more and more tightly held on the shaft of the reel. The roll is very difficult, therefore, to remove from the reel. In some prior art reels, it has been known to make one of the end cheeks removable. This in no way solves the problem of the tight adherence of the roll on the reel. The removal of one end cheek simply allows better access to the paper roll. The paper roll can then be drawn from the shaft. In other prior art reels, protrusions have been provided on the removable end cheek extending across a portion of the shaft of the reel serving the dual function of gripping the start portion of the paper web to commence winding against the shaft and of providing a removable component of the shaft to relieve tension in the reel when the end sheet is removed. These other prior art reels are disadvantageous in that they provide for an asymmetry in the winding of the paper web onto the reel and in that the projections across the shaft must be mechanically exceedingly strong to prevent becoming wedged against the shaft causing the end check with which they are in association to become irremovable.

In starting the winding of the paper web onto a reel, it is necessary to feed by some means the beginning portion of the web onto the shaft. In some prior art reels, it is known to provide a slot in the shaft angled so as to grip the beginning of the web when the beginning of the web is fed therethrough and the shaft rotates in a preferred direction. This is quite an intricate operation and further requires that the reel be placed into whatever equipment it is to become part of in the correct orientation. If placed in the incorrect orientation, the reel will commence to rotate and merely pull the beginning portion of the web from the slot in the shaft. As earlier described, some other prior art reels grasp the paper beneath a projection extending across the shaft. In commencing the paper in such an apparatus, it is necessary to ensure that the tight-fitting projection passes over the paper. Once again, this is quite an intricate operation and time consuming. It is further necessary to ensure that the paper is started around the shaft in the correct direction.

In all of the prior are reels, the reel is made in two non-identical parts. The tooling costs of each part, being different, is cumulative and the cost of the reel is not minimal. Further, the manner of construction of the reels and constraints upon materials means that a mixture of metal and plastic parts must be employed.

It is, therefore, desirable to provide a reel for the winding thereon of a web where tooling costs are minimized, where the starting thereon of a web of paper is readily achieved and where the removal of a roll of paper wound onto the shaft is facilitated.

SUMMARY OF THE INVENTION

The present invention consists in a reel having first and second end cheeks and a shaft, said reel being rotatable about the axis of said shaft for winding onto said shaft, between said first and second end cheeks, of a web to form a roll, said reel being demountable for removal from said reel of said roll, said reel comprising; first and second sub-assemblies, each of said first and second sub-assemblies comprising; a respective one of said first or second end cheeks, a plurality of fingers on said respective end cheek extensive in the direction of said shaft, adjacent pairs of said fingers defining alternate circumferential portions of the surface of said shaft, a corresponding plurality of first portions of each of a corresponding plurality of clips, one on the distal end of each of said plurality of fingers, and a corresponding plurality of second portions of each of said corresponding plurality of clips on said respective end cheeks, one between each adjacent pair of said plurality of fingers, where each of said plurality of fingers on said first subassembly is interposable between one adjacent pair of said plurality of fingers on said second subassembly in opposition thereto for each of said first portions of said plurality of clips respectively on said first and second sub-assemblies to engage a corresponding one of said plurality of second portions of said plurality of clips respectively on said second and said first sub-assemblies to hold together said first and second sub-assemblies, said plurality of fingers on said first sub-assembly and said plurality of fingers on said second sub-assembly being co-operative to define the entire circumferential surface of said shaft and to grip the web therebetween.

BRIEF DESCRIPTION OF THE PREFERRED EMBODIMENTS

In a first preferred embodiment of the present invention, a reel is provided for taking up and holding a continuous record of the transactions of an autoteller printed on a paper web. The reel is preferably driven by means of a solenoid operated ratchet. In the preferred embodiment, the reel comprises first and second identical sub-assemblies. Each sub-assembly comprises an end cheek and first and second fingers. Each of the first and second fingers defines a quadrant of the surface of the shaft of the reel. At the distal end of each of the fingers, there is provided a catch and a finger supporting protrusion. In between the first and second fingers on either side, there is provided an aperture.

In use, the paper web is first threaded between the first and second fingers of the first sub-assembly. Thereafter the second sub-assembly is placed in opposition to the first sub-assembly and its fingers rotated through 90° to pass about the paper web for the catch and finger supporting protrusion on each of the fingers of the second sub-assembly to engage the apertures in the first subassembly and for the catch and the finger supporting protrusion to each of the fingers of the first sub-assembly to engage the apertures in the second sub-assembly. Thereafter the reel may be wound in either direction. The first and second fingers respectively in the first and second sub-assemblies define between them the entire surface of the shaft of the reel. The protrusions supporting the fingers prevent the tension in the roll of paper formed on the shaft from keeping the clips jammed in the aperture. The shaft of the reel can, therefore, be disassembled by pulling apart of the first and second sub-assemblies. This relieves tension in the roll allowing its removal from the residual portion of the shaft.

In a second preferred embodiment, the shaft is divided into two sets of three fingers, there being three fingers in each sub-assembly. In the same manner as for the first preferred embodiment, the fingers comprise catches and finger supporting protrusions on their distal ends for mating with apertures in the end cheeks of each of the sub-assemblies.

BRIEF DESCRIPTION OF THE DRAWINGS

The invention is further explained, by way of an example, by the following description taken in conjunction with the appended drawings in which.

DETAILED DESCRIPTION OF THE PREFERRED EMBODIMENTS

Figure 1:
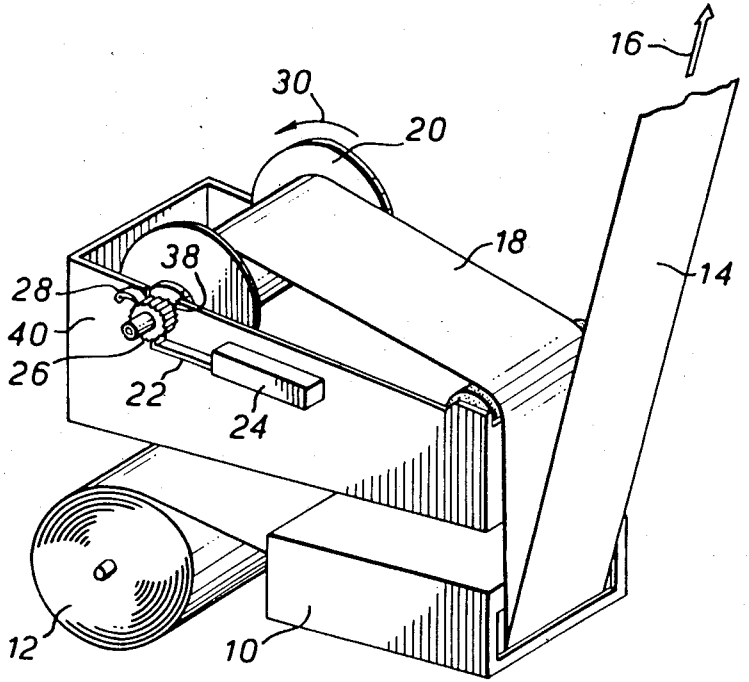
FIG. 1 shows, by way of an example, the field of application of the first preferred embodiment of the present invention.

FIG. 1 shows, by way of an example, one field of application of the present invention.

In an autoteller for dispensing money to bank customers upon presentation of a card, a running record or "audit trail" is maintained of each transaction. A printer 10 is controlled by an internal processor in the autoteller to print a customer receipt on self-copying paper taken from a supply roll 12. The printer 10 prints details of each transaction. Thereafter the top sheet 14 of the self-copying paper is taken as indicated by the arrow 16 to be cut and conveyed to the customer. A carbon copy back sheet 18 is wound onto a reel 20 by means of a driving pawl 22 driven by a solenoid 24 acting upon a ratchet 26 fixed to the axis of the reel 20. A holding pawl 28 also acts upon the ratchet 26 to prevent the reel 20 from unwinding the back sheet 18 after the reel 20 has been advanced as indicated by the arrow 30 to take up the back sheet 18.

This application so far described is by way of example only. The present invention may equally be used for maintaining a continuous printed record on a reel of paper in a cash register or point of sale terminal. Equally, the present invention can be used for winding a roll of photographic film or for accepting a removable ink ribbon as in a typewriter or an impact printing apparatus.

Figure 2A:
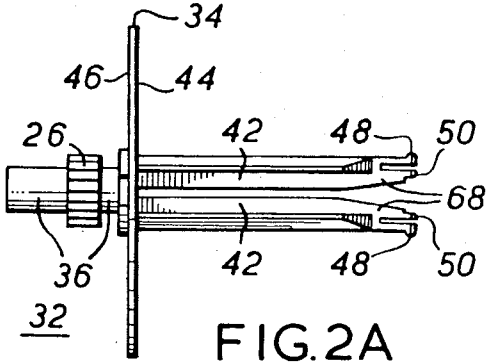
FIG. 2A shows a plan view of a sub-assembly, two such sub-assemblies being required for making a reel.

FIG. 2A shows a plan view of a first half of the reel 20 shown in FIG. 1. FIG. 2A shows a first sub-assembly 32. The reel 20 is made from two identical sub-assemblies combined together in a manner later described.

The first sub-assembly 32 comprises a circular first end cheek 34. The first end cheek 34 is provided with an axle 36 whereon the ratchet 26 is provided. The axle 36 allows for rotation of the reel 20 when the reel 20 is dropped into a pair of opposed slots 38 in a frame 40 shown in FIG. 1.

The first sub-assembly 32 is further provided with a pair of fingers 42. The fingers 42 are fixed to a first face 44 of the end cheek 34 and the axle 36 is affixed to a second face 46 of the first end cheek 34. The fingers 42 are symmetrically disposed on either side of the axis of the spindle of the reel 20. Each finger 42 is provided at its distal end firstly with an elastic clip 48 and secondly with a finger bearing protrusion 50. In a manner later to be described, the clip 48 and the protrusion 50 co-operate in the formation of the reel 20.

Figure 2B:
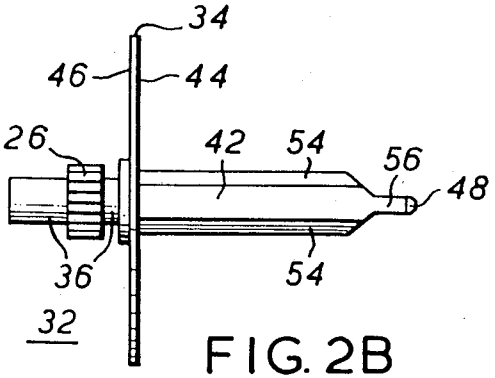
FIG. 2B shows an elevation of the sub-assembly of FIG. 2A.

FIG. 2B shows an elevated view of the sub-assembly 32 of FIG. 2A.

Each finger 42 comprises a bearing surface 52 having a sloping portion 54 on either edge thereof. The width of the distal portion 56 of each finger 42 is reduced to provide for the provision of the elastic clip 48 in a manner that will later be described whereby the clip 48 may pass through an aperture in the end cheek 34. As will later be described, the bearing surface 52 of each finger 42 serves to support a roll of paper when the reel 20 is assembled. The sloping portions 54 of each finger 42 serve to provide a smooth continuity between one finger 42 and another in the assembled reel 20.

Figure 2E:
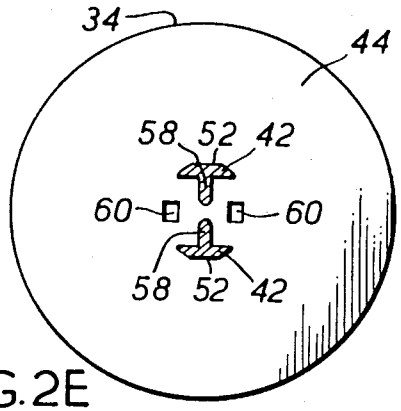
FIG. 2E shows a cross-section through the fingers of FIG. 2C taken along the line X—X' looking in the direction of the arrows.
Figure 2F:
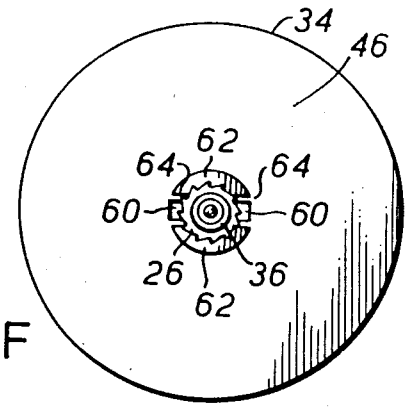
FIG. 2F shows a view of the sub-assembly of FIG. 2D looking in the direction of the arrow.
Figure 2C:
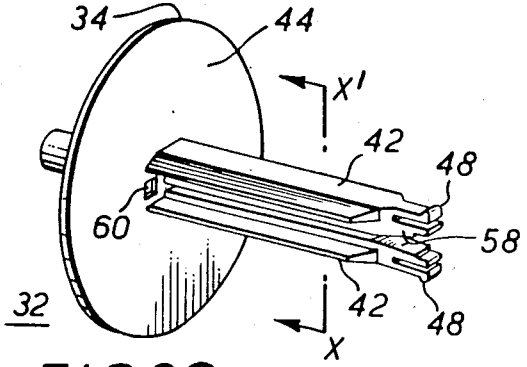
FIG. 2C shows a projected view of the subassembly shown in FIG. 2A.

FIG. 2C shows a projected view of the sub-assembly 32 otherwise shown in FIG. 2A viewed from the direction of the first face 44 of the end cheek 34. Each finger 42 is provided with a central strengthening spine 58. The central strengthening spines 58 on the pair of fingers 42 in each sub-assembly 32 extend towards the axis of rotation of the shaft of the reel 20 but do not meet. They, therefore, define a space therebetween. The central strengthening spine 58 of each finger 42 is substantially radial with regard to the end cheek 34. The fingers 42 overhang a pair of apertures 60 through-penetrative of the end cheek 34. While in FIG. 2C only one aperture 60 is shown between the fingers 42 it is to be understood that a second aperture 60 is provided on the other side of the fingers 42 as shown in a corresponding symmetrical position. The apertures 60, as will later be described, are used in conjunction with the elastic clips 48 and the finger bearing protrusions 50 in the assembly of the reel 20.

Figure 2D:
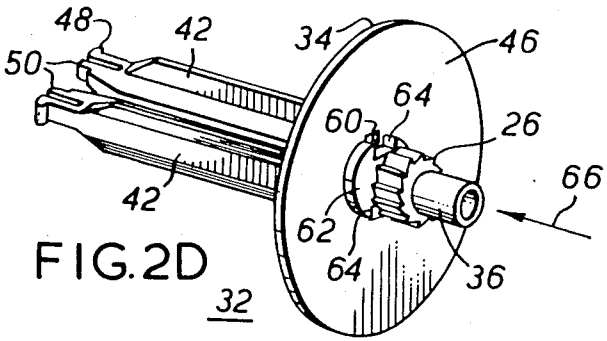
FIG. 2D shows a projected view of the subassembly shown in FIG. 2B.

FIG. 2D shows a projected view of the subassembly 32 of FIG. 2B viewed from the direction of the second face 46 of the end cheek 34. The axis 36 is affixed to the end cheek 34 by means of a strengthening collar 62. The collar 62 is provided with cutaways 64 exposing the apertures 60 shown in FIG. 2C. While only one cutaway 64 is clearly visible in FIG. 2D, it is to be understood that a pair exist on opposite sides of the axle 36, one for each of the pair of apertures 60, one of which is shown in FIG. 2C.

FIG. 2E is a cross-sectional view of the fingers 42 of FIG. 2C looking in the direction of the end check 34 on its first face 44 along the line X—X' viewed in the direction of the arrows. FIG. 2E illustrates how the apertures 60 are disposed between the bearing surfaces 52 of the fingers 42 on either side of the strengthening spines 58. FIG. 2E further shows how the strengthening spines 58 leave a gap therebetween for the passing therethrough of the paper web 18 when the reel 20 is assembled prior to winding of the web 18.

FIG. 2F shows a view of the second face 46 of the end cheek 34 shown in FIG. 2D viewed in the direction of the arrow 66. FIG. 2F particularly shows the manner whereby the apertures 60 are exposed by the cutaways 64 in the collar 62 such that penetration from the first face 44 of the end cheek 34 to the second face 46 of the end cheek 44 is possible without obstruction by the collar 62.

In this preferred embodiment, the sub-assembly 32 is assembled from a number of discreet components. The fingers 42 are secured to the end cheek 34 by means of a number of screws through-penetrative of the end cheek 34 from its second face 46 to its first face 44. The collar 62 is affixed by two or more screws penetrating from the second face 46 of the end cheek 34 either into the end cheek 34 itself or into the fingers 42. The axle 36 and the ratchet 26 are screwed onto the collar 62. This form of construction is for preference only. The collar 62 need not be of such a size that cutaways 64 are required to expose the apertures 60. The whole sub-assembly 32 can be molded from a resilient thermosetting or thermoplastic resin in a one-shot molding operation. A multi-part die can be used for such a molding operation. As will later become apparent, the entire reel 20 is formed from two identical sub-assemblies 32. The molding of the sub-assembly 32 in a single operation, therefore, makes a low cost reel 20 with almost no assembly charges.

Figure 3A:
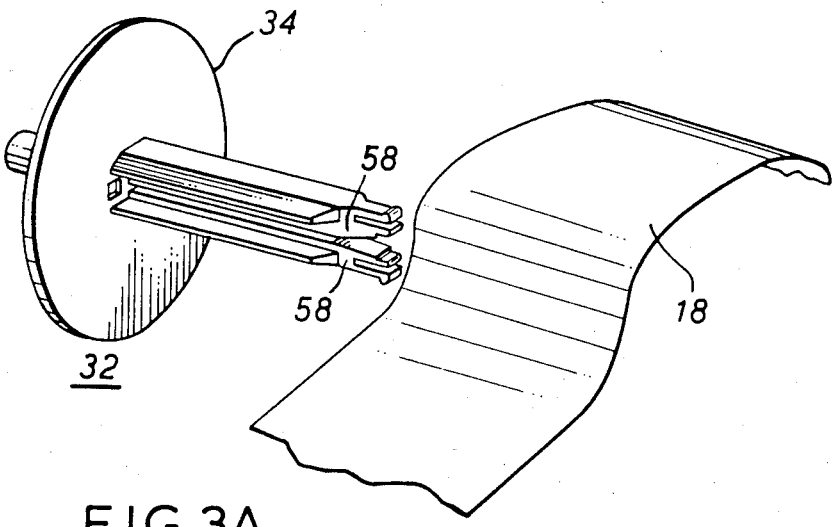
FIG. 3A shows the first stage in the assembly of the reel about a paper web.

FIG. 3A shows the first stage in assembly of the reel 20 about the back sheet 18. It is to be understood that the back sheet 18 can be replaced by any other windable web material. The first sub-assembly 32 is positioned with the back sheet 18 ready to slide between the central strengthening spines 58 towards the end cheek 34.

Figure 3B:
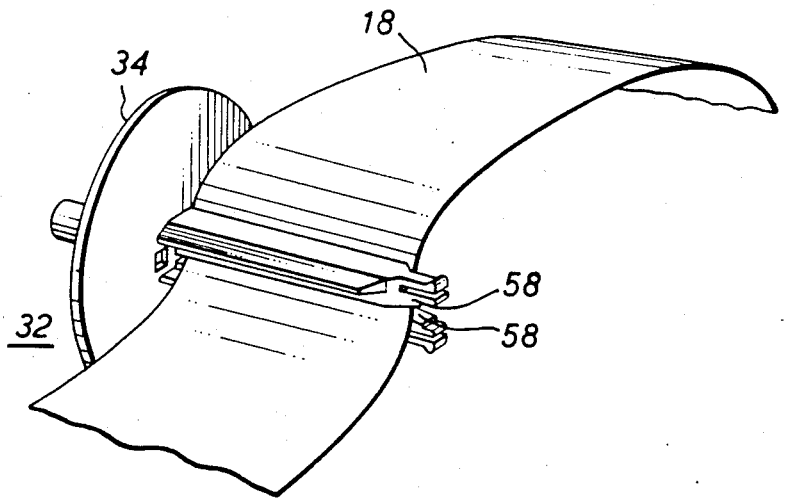
FIG. 3B shows the second stage of reel assembly.

FIG. 3B shows the second stage in assembly of the reel 20 with the back sheet 18 in position ready for winding. The back sheet 18 is slid between the strengthening spines 58 into proximity with the end cheek 34. To facilitate entry of the back sheet 18 between the central strengthening spine 58, the central strengthening spines 58 are provided at their distal ends each with a sloping surface 68 (shown in FIG. 2A) to provide a funneling effect for the back sheet 18 therebetween.

Figure 3C:
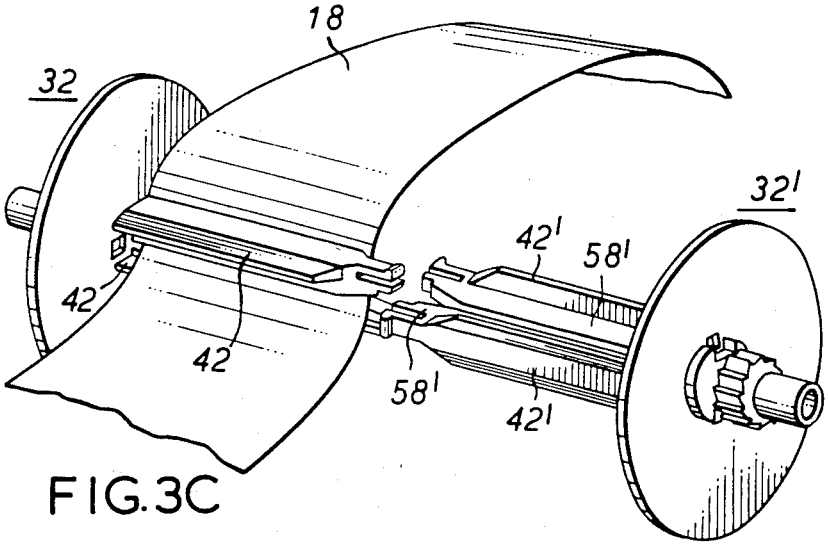
FIG. 3C shows the third stage of reel assembly.

FIG. 3C shows the third stage in assembly of the reel 20 with the back sheet 18 held therein ready for winding. A second sub-assembly 32', identical to the first sub assembly 32, is introduced in opposition to the first sub-assembly 32. The fingers 42' of the second sub-assembly 32' are rotated relative to the fingers 42 of the first sub-assembly 32 through an angle of 90° about the axis of the shaft of the reel 20 such that the central strengthening spines 58' of the fingers 42' of the second sub-assembly 32' can pass between the fingers 42 of the first sub-assembly 32.

Figure 3D:
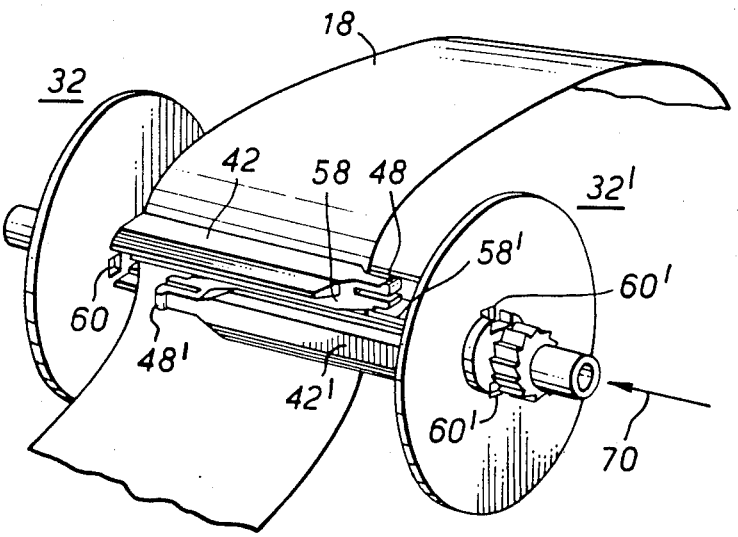
FIG. 3D shows the fourth stage in assembly of the reel.

FIG. 3D shows the fourth stage in assembly of the reel 20 about the back sheet 18 ready for winding. The second sub-assembly 32' is urged in the direction indicated by the arrow 70 for the strengthening spines 58' of the second sub-assembly 32' to fall astride the back sheet 18 just as the back sheet 18 sits between the strengthening spines 58 of the first sub-assembly 32. The elastic clip 48' of each finger 42' of the second sub-assembly 32' is urged towards the corresponding aperture 60 in the end cheek 34 of the first sub-assembly and the elastic clip 48 of each finger 42 of the first sub-assembly 32 is urged towards the corresponding aperture 60' in the end cheek 34' of the second sub-assembly 32'.

Figure 3E:
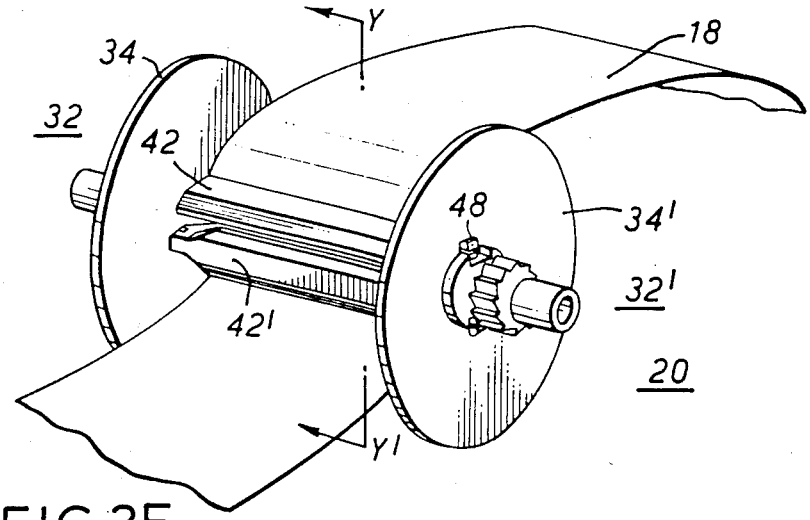
FIG. 3E shows the fifth and final stage of assembly of the reel where the two sub-assemblies are finally united about the paper web.

FIG. 3E shows the final stage of assembly of the reel 20 about the back sheet 18 prior to winding. The elastic clips 48,48' have passed completely through their corresponding apertures 60,60' to hold the two sub-assemblies 32,32' together. The back sheet 18 is clapsed between the two sets of fingers 42,42' respectively from the first and second sub-assemblies 32,32'. The end cheeks 34,34' of the sub-assemblies 32,32'. define the end cheeks of the reel 20. The clips 48,48' and the apertures 60,60' co-operate to hold the reel 20 together. The two sets of fingers 42,42' are co-operative to form the shaft of the reel 20.

Figure 4A:
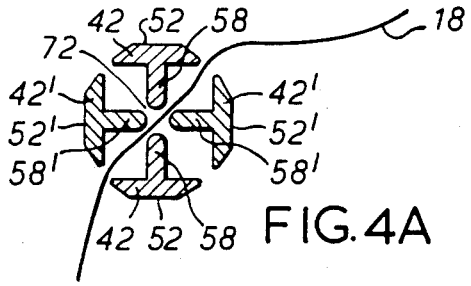
FIG. 4A shows a cross-sectional view of the shaft of FIG. 3E taken along the line Y—Y' looking in the direction of the arrows, in particular indicating the disposition of the paper web between the pairs of fingers.

FIG. 4A shows a cross-section through the assembled reel 20 of FIG. 3E taken along the line Y—Y' looking in the direction of the arrows. The sets of fingers 42,42' co-operate such that their respective bearing surfaces 52,52' define the entire outer surface of the shaft of the reel 20. The back sheet 18 passes between the two sets of fingers 42,42' passing through the common void 72 between the two sets of central strengthening spines 58,58'. The corners of the fingers 42, are made sharp for the back sheet 18 to catch thereon irrespective of the direction of rotation of the reel 20. Thus, taken from the starting point shown in FIG. 4A, it is immaterial to the geometry of winding which direction the reel 20 is rotated. Since both subassemblies 32 are identical one to the other, the reel 20 may be assembled without any attention whatever being paid to winding directions. The reel 20 need then merely be dropped in the frame 40 for operation to commence. The ratchet 26 on each sub-assembly 32 is usable. Thus, with regard to FIG. 1, the reel 20 may be driven on one side of the frame 40 only or may be driven on both sides by separately operable driving means. It is to be appreciated that the means for rotating the reel 20 need not be a solenoid 24 as indicated, but could comprise gear wheels, demountable belts, stepping motors and the like. In the event of a gear wheel chain being used, the ratchet 26 is replaceable with a final gear wheel. In the event of the reel 20 being drivable using belts, the ratched 26 can be replaced by means of a pulley wheel.

Figure 4B:
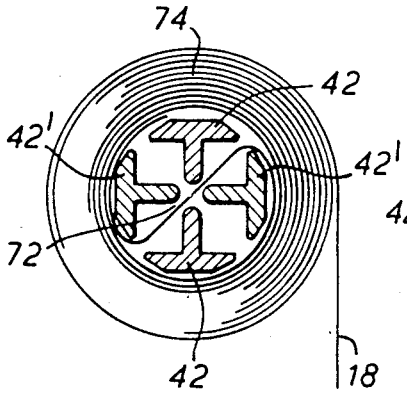
FIG. 4B shows the manner in which a roll of paper is wound about the shaft.

FIG. 4B shows a roll 74 of the back sheet 18 assembled on the cross-sectional reel 20 otherwise shown in FIG. 4A. The roll 74 comprises many layers of the back sheet 18, each contributing its own tension to the roll 74. The roll 74 therefore crushes the fingers 42, 42' towards the common void 72. It would be difficult to remove the roll 74 from the combination of fingers 42,42'.

Figure 4C:
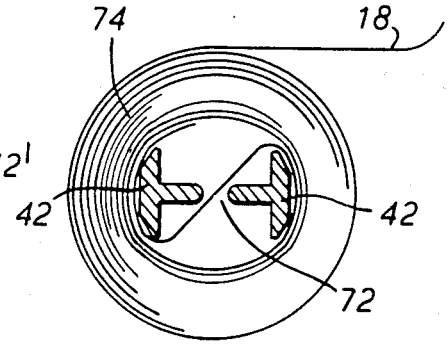
FIG. 4C shows the manner in which the removal of one of the sub-assemblies relieves tension in the roll of paper to allow the roll of paper to be removed from the fingers of the remaining sub-assembly.

FIG. 4C shows the manner of removing the roll 74 from the reel 20. The reel 20 is disassembled using the reverse sequence to that shown in FIGS. 3A to 3E. The roll 74 remains upon the first fingers 42. The removal of the second fingers 42' allows the partial collapse of the roll 74 towards the common void 72, thereby relieving tension in the roll 74. The fingers 42 of the first sub-assembly 32 can thereafter readily be withdrawn from the roll 74. After withdrawal from the roll 74 the back sheet 18 can once more be introduced ready for winding into the reel 20. It is to be understood that in all the foregoing description there is no distinction to be made between the first sub-assembly 32 and the second sub-assembly 32' and any foregoing description implying a particular order in assembly or disassembly may have the two sub-assemblied 32,32' reversed.

Figures 5, 6A, 6B:
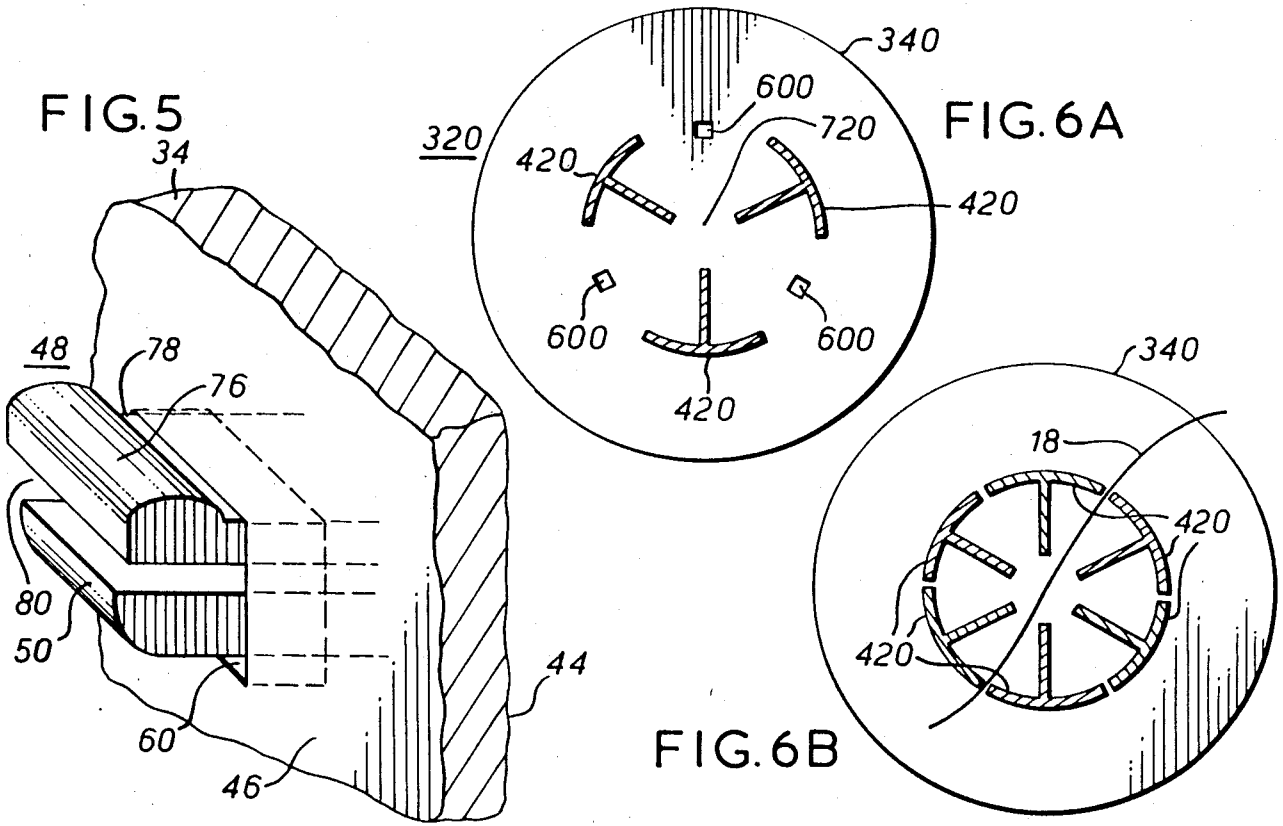
FIG. 5 shows detail of the manner in which the catch and finger supporting protrusion engage the apertures in the end cheek of the opposite sub-assembly.
FIG. 6A shows a projected view looking along the shaft towards the end cheek of a second preferred embodiment of a sub-assembly according to the present invention.
FIG. 6B shows a cross-section of the shaft and a projected view of the end cheek of a completed reel assembled according to the present invention using a pair of sub-assemblies as shown in FIG. 6A.

FIG. 5 shows magnified detail of the manner in which the elastic clip 48 and the finger bearing protrusions 50 co-operate with the aperture 60 in the end cheek 34 of each sub-assembly 32 for the holding together of the reel 20 and for its support against the radial crushing forces described in connection with FIG. 4B.

The elastic clip 48 comprises a terminal boss 76 on an elastic arm 78. As each arm 78 is urged towards the end cheek 34, so the terminal boss 76 and the finger bearing protrusion 50 engage the aperture 60 on the first face 44 of the end cheek 34. Together the terminal boss 76 and the finger bearing protrusion 50 are forced through the aperture 60. The terminal boss 76 causes distortion of the elastic arm 78 when the edge of the aperture 60 most remote from the axis of the reel 20 engages the terminal boss 76 to urge it towards the gap 80 between the terminal boss 76 and the finger bearing protrusion 50. As the terminal boss 76 emerges on the second face 46 of the end cheek 34, so the elastic arm 78 restores the position of the terminal boss 76 and the terminal boss 76 can thereafter engage the second face 46 of the end cheek 34 to hold the reel 20 together.

As the tension in the roll 74 as shown in FIG. 4B causes radial compression of the fingers 42, so the protrusion 50 alone reacts to that tension and supports each arm 78 by engaging that surface of the aperture 60 nearest the axis of rotation of the reel 20. The finger bearing protrusion 50 therefore prevents pressure being applied to the elastic clip 48. As shown in FIG. 5, the elastic clip is so disposed with a rounding of the terminal boss 76 such that, the finger bearing protrusion 50 having no obstructing asperities, the distal portion of each arm 78 may be withdrawn from the aperture 60 in each case. Since the terminal boss 76 must be forced towards the axis of rotation for opening of the elastic clip 48, the configuration shown in FIG. 5 is such that opening of the two halves of the reel 20, at least insofar as the action of the elastic clip 48 is concerned, is facilitated by increasing tension in the roll 74 as opposed to being made more difficult.

It is to be appreciated that the elastic clip 48 and the finger bearing protrusion 50 may be made separate from one another. It is further to be appreciated that the role of the aperture 60 may be replaced by one or more additional components only partly through-penetrative of the end cheek 34. The terminal boss 76 together with the elastic arm 78 make a first portion of the clip 48 and the aperture makes a second portion. The finger bearing protrusion 50 makes a first portion of a finger support and the aperture 60 makes a second portion of a support for the fingers 42.

FIG. 6A shows a view of a second preferred embodiment of the invention corresponding to that of the first preferred embodiment shown in FIG. 2E. Here three modified fingers 420 are disposed on a modified end cheek 340 having modified apertures 600 about a modified common void 720 to form a modified sub-assembly 320. Each of the modified fingers 420 is provided with clip and a finger bearing protrusion as indicated for the first preferred embodiment. The manner of operation and assembly is the same as for the first preferred embodiment, save that instead of there being a total of four fingers 42 to define the shaft of the reel 20, there are a total of six fingers.

FIG. 6B shows a view of the assembled reel of the second preferred embodiment corresponding to a cross-section of the shaft looking towards a modified end cheek 340. As can be seen, each of the modified fingers 420 serves to define a portion of the shaft of a reel. When one of the sub-assemblies is removed, so the roll 74 of web 18 may be removed from the remaining three fingers 42. In assembly, rather than there being only two positions whereat the second sub-assembly 32' may be engaged with the first sub-assembly 32, in the second preferred embodiment each sub-assembly 320 has three positions whereat it may be united with another sub-assembly 320. It is to be appreciated that other embodiments of the invention exist having any number of fingers 42,420 disposed about a common void 72,720 where the fingers from a second sub-assembly 32' may be interposed therebetween to engage the opposite end cheek 34,340 to define the shaft of a reel.

It is to be appreciated that the sub-assemblies 32,320 need only be identical one to the other within the terms of the functions hereinbefore described. Minor differences therebetween are permissible within the present invention. While it is preferred that both sub-assemblies 32,320 be identical for reasons of economy of tooling and manufacture, it is to be appreciated that any two mutually co-operative sub-assemblies as hereinbefore described can be used to embody the present invention.

What I claim is:

1. A reel comprising two sub-assemblies, each of said sub-assemblies including:

an end check;

a plurality of fingers coupled to said end cheek;

a first clip portion on the distal end of each of said plurality of fingers;

a first finger support portion on the distal end of each of said plurality of fingers; and a plurality of second clip portions, corresponding in number to said plurality of fingers on said end cheek.

2. The reel in accordance with claim 1 wherein:

said plurality of fingers are coupled to said end cheek in a direction perpendicular to a surface of said end cheek;

said plurality of second clip portions is formed within said surface of said end cheek; and wherein each of said plurality of fingers on each one of said sub-assemblies is interposable between two of said plurality of fingers on the other one of said sub-assemblies for each of said first clip portions included in each one of said sub-assemblies to engage a corresponding one of said plurality of second clip portions included in the other one of said sub-assemblies.

3. The reel in accordance with claim 1 wherein said first clip portion includes an elastically restored boss at the distal end of an elestic arm and wherein each of said second clip portions includes an aperture in said end cheek.

4. The reel in accordance with claim 1 further including a plurality of second finger support portions, corresponding in number to said plurality of fingers, on said end cheek.

5. The reel in accordance with claim 1 wherein said first clip portion includes an elastically restored boss at the distal end of an elastic arm and wherein each of said second clip portions includes an aperture in said end cheek.

6. The reel in accordance with claim 5 wherein said first finger support portion includes a bearing protrusion.

7. A reel having first and second end cheeks and a shaft, said reel being rotatable about the axis of said shaft for winding onto said shaft, between said first and second end cheeks, of a web to form a roll, said reel being demountable for removal from said reel of said roll, said reel comprising; first and second sub-assemblies, each of said first and second sub-assemblies comprising; a respective one of said first or second end cheeks, a plurality of fingers on said respective end cheek extensive in the direction of said shaft, adajcent pairs of said fingers defining alternate circumferential portions of the surface of said shaft, a corresponding plurality of first portions of each of a corresponding plurality of clips, one on the distal end of each said plurality of fingers, and a corresponding plurality of second portions of each of said corresponding plurality of clips on said respective end cheek, one between each adjacent pair of said plurality of fingers, where each of said plurality of fingers on said first sub-assembly is interposable between an adjacent pair of said plurality of fingers on said second sub-assembly in opposition thereto for each of first portions of said plurality of clips respectively on said first and second sub-assemblies to engage a corresponding one of said plurality of second portions of said plurality of clips respectively on said second and said first sub-assemblies to hold together said first and second sub-assemblies, said plurality of fingers on said first sub-assembly and said plurality of fingers on said second sub-assembly being co-operative to define the entire circumferential surface of said shaft and to grip the web therebetween; and wherein each of said first and second sub-assemblies comprises a corresponding plurality of first portions of a corresponding plurality of finger supports, one at the distal end of each of said plurality of fingers, and a corresponding plurality of second portions of said corresponding plurality of finger supports, on said respective end cheek, one between each adjacent pair of said plurality of fingers, said first portions of said finger supports respectively on said first and second sub-assemblies being operative to engage said second portions of said finger supports respectively on said second and said first sub-assemblies to support said pluralities of fingers respectively on said first and second sub-assemblies against tension in said web.

8. A reel according to claim 7 wherein said first and second sub-assemblies are identical one to the other.

9. A reel according to claim 1 wherein said finger supports and said clips are disposed for said finger supports to support said fingers against increasing closure force in said clips with increasing tension in said web to allow disengagement between said first and said second portions of said clips.

10. A reel according to claim 9 wherein each of said first portions of said clips comprises an elastically restored boss at the distal end of an elastic arm and wherein each of said second portions of said clips comprises an aperture in said respective end cheek, each boss being displacable in passage through its corresponding aperture from a first face of said respective end cheek to a second face of said respective end cheek for said corresponding elastic arm to urge said boss to engage said second face of said respective end cheek.

11. A reel according to claim 10 wherein each of said first portions of said finger supports comprises a bearing protrusion for engaging a first edge of a corresponding one of said plurality of apertures, each of said bosses being operative to engage a second edge of a corresponding one of said plurality of apertures, said first edge being more proximate to said axis of said shaft than said second edge.

12. A reel according to claim 7 wherein said plurality of fingers respectively on said first and second subassemblies are removable from between said plurality of fingers respectively on said second and said first subassemblies with said roll on said shaft to leave said roll on said plurality of fingers respectively on said second or said first sub-assembly to relieve tension in said roll by partial disassembly of said shaft to allow removal of said roll from said plurality of fingers respectively on said second or said first sub-assembly.

13. A reel according to claim 8 wherein said plurality of fingers respectively on said first and second sub-assemblies are removable from between said plurality of fingers respectively on said second and said first sub-assemblies with said roll on said shaft to leave said roll on said plurality of fingers respectively on said second or said first sub-assembly to relieve tension in said roll by partial disassembly of said shaft to allow removal of said roll from said plurality of fingers respectively on said second or said first subassembly.

14. A reel according to claim 1 wherein said plurality of fingers respectively on said first and second sub-assemblies are removable from between said plurality of fingers respectively on said second and said first sub-assemblies with said roll on said shaft to leave said roll on said plurality of fingers respectively on said second or said first sub-assembly to relieve tension in said roll by partial disassembly of said shaft to allow removal of said roll from said plurality of fingers respectively on said second or said first subassembly.

15. A reel according to claim 11 wherein each of said first and second sub-assemblies is a one-shot molding.

16. A reel according to claim 11 wherein said plurality of fingers respectively on each of said first and second sub-assemblies consists of a pair of fingers on each of said first and second sub-assemblies.

17. A reel according to claim 1 wherein each of said first portions of said clips comprises an elastically restored boss at the distal end of an elastic arm and wherein each of said second portions of said clips comprises an aperture in said respective end cheek, each boss being displacable in passage through its corresponding aperture.

18. A reel having first and second end cheeks and a shaft, said reel being rotatable about the axis of said shaft for winding onto said shaft, between said first and second end cheeks, of a web to form a roll, said reel being demountable for removal from said reel of said roll, said reel comprising; first and second sub-assemblies, each of said first and second sub-assemblies comprising; a respective one of said first or second end cheeks, a plurality of fingers to said respective end cheek exttensive in the direction of said shaft, adjacent pairs of said fingers defining alternate circumferential portions of the surface of said shaft, a corresponding plurality of first portions of each of a corresponding plurality of clips, one on the distal end of each said plurality of fingers, and a corresponding plurality of second portions of each of said corresponding plurality of clips on said respective end cheek, one between each adjacent pair of said plurality of fingers, where each of said plurality of fingers on said first sub-assembly is interposable between an adjacent pair of said plurality of fingers on said second sub-assembly in opposition thereto for each of first portions of said plurality of clips respectively on said first and second sub-assemblies to engage a corresponding one of said plurality of second portions of said plurality of clips respectively on said second and said first sub-assemblies to hold together said first and second sub-assemblies, said plurality of fingers on said first sub-assembly and said plurality of fingers on said second sub-assembly being co-operative to define the entire circumferential surface of said shaft and to grip the web therebetween; wherein said first and second sub-assemblies are idential one to the other; and wherein each of said first and second sub-assemblies comprises a corresponding plurality of first portions of a corresponding plurality of finger supports, one at the distal end of each of said plurality of fingers, and a corresponding plurality of second portions of said corresponding plurality of finger supports, on said respective end cheek, one between each adjacent pair of said plurality of fingers, said first portions of said finger supports respectively on said first and second sub-assemblies being operative to engage said second portions of said finger supports respectively on said second and said first sub-assemblies to support said pluralities of fingers respectively on said first and second sub-assemblies against tension in said web.

19. A reel according to claim 18 wherein said finger supports and said clips are disposed for said finger supports to support said fingers against increasing closure force in said clips with increasing tension in said web to allow disengagement between said first and said second portions of said clips.

20. A reel according to claim 19 wherein each of said first portions of said clips comprises an elastically restored boss at the distal end of an elastic arm and wherein each of said second portions of said clips comprises an aperture in said respective end cheek, each boss being displaceable in passage through its corresponding aperture from a first face of said respective end cheek to a second face of said respective end cheek for said corresponding elastic arm to urge said boss to engage said second face of said respective end cheek.

21. A reel according to claim 20 wherein each of said first portions of said finger supports comprises a bearing protrusion for engaging a first edge of a corresponding one of said plurality of apertures, each of said bosses being operative to engage a second edge of a corresponding one of said plurality of apertures, said first edge being more proximate to said axis of said shaft than said second edge.

22. A reel according to claim 21 wherein each of said first and second sub-assemblies is a one-shot molding.

23. A reel according to claim 21 wherein said plurality of fingers respectively on each of said first and second sub-assemblies consists of a pair of fingers on each of said first and second sub-assemblies.

24. A reel according to claim 12 wherein each of said first and said second sub-assemblies is a one-shot molding.

25. A reel according to claim 12 wherein said plurality of fingers respectively on each of said first and second sub-assemblies consists of a pair of fingers on each of said first and second sub-assemblies.

26. A reel according to claim 13 wherein each of said first and said second sub-assemblies is a one-shot molding.

27. A reel according to claim 13 wherein said plurality of fingers respectively on each of said first and second sub-assemblies consists of a pair of fingers on each of said first and second sub-assemblies.

28. A reel according to claim 14 wherein each of said first and said second sub-assemblies is a one-shot molding.

29. A reel according to claim 14 wherein said plurality of fingers respectively on each of said first and second sub-assemblies consists of a pair of fingers on each of said first and second sub-assemblies.

* * * * *